US007451748B2

(12) United States Patent
Nigoro et al.

(10) Patent No.: US 7,451,748 B2
(45) Date of Patent: Nov. 18, 2008

(54) EGR COOLER SYSTEM

(75) Inventors: Takuya Nigoro, Toyota (JP); Tatsuhisa Yokoi, Toyota (JP); Akiyuki Iemura, Susono (JP); Tetsuo Ide, Toyota (JP); Seiji Sasaki, Toyota (JP); Ryouhei Kusunoki, Toyonaka (JP); Toshio Yamamoto, Kashiwara (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 86 days.

(21) Appl. No.: 11/496,473

(22) Filed: Aug. 1, 2006

(65) Prior Publication Data

US 2007/0028902 A1 Feb. 8, 2007

(30) Foreign Application Priority Data

Aug. 2, 2005 (JP) ..... 2005-223766

(51) Int. Cl.
*F02B 33/00* (2006.01)

(52) U.S. Cl. ..... 123/568.12; 123/540; 123/543

(58) Field of Classification Search ..... 123/568.12, 123/540, 543

See application file for complete search history.

(56) References Cited

U.S. PATENT DOCUMENTS

| | | | | |
|---|---|---|---|---|
| 6,543,427 | B2 * | 4/2003 | Kawasaki | 123/568.12 |
| 6,848,434 | B2 * | 2/2005 | Li et al. | 123/568.12 |
| 7,178,326 | B2 * | 2/2007 | Kojima et al. | 60/278 |
| 2003/0089319 | A1 | 5/2003 | Duvinage et al. | |

FOREIGN PATENT DOCUMENTS

| | | | |
|---|---|---|---|
| DE | 197 36 606 A1 | | 3/1998 |
| DE | 103 40 908 A1 | | 3/2005 |
| DE | WO 2005073535 | * | 8/2005 |
| JP | 3539238 | | 4/2004 |
| JP | 2004-204828 | | 7/2004 |
| JP | 2004204828 A | * | 7/2004 |
| WO | WO 2005/073535 A1 | | 8/2005 |

* cited by examiner

*Primary Examiner*—Stephen K. Cronin
*Assistant Examiner*—Sizo B Vilakazi
(74) *Attorney, Agent, or Firm*—Oblon, Spivak, McClelland, Maier & Neustadt, P.C.

(57) ABSTRACT

An EGR cooler system according to the invention includes an EGR cooler cooling device that is provided in a coolant path which is separate from the path provided with an engine cooling system which cools coolant. The EGR cooler cooling devices cools the coolant to be supplied to a water-cooled EGR cooler. The EGR cooler system also includes a water pump that circulates the coolant within the coolant path; a bypass passage through which the coolant may bypass the EGR cooler cooling device or the water-cooled EGR cooler; and a flow control valve that regulates the amount of coolant flowing into the bypass based on the temperature of the coolant flowing through the coolant path.

17 Claims, 2 Drawing Sheets

EGR COOLER SYSTEM

INCORPORATION BY REFERENCE

The disclosure of Japanese Patent Application No. 2005-223766 filed on Aug. 2, 2005 including the specification, drawings and abstract is incorporated herein by reference in its entirety.

BACKGROUND OF THE INVENTION

1. Field of the Invention

The invention relates to an EGR cooler system for an exhaust gas recirculation system. The exhaust gas recirculation system sends part of the exhaust gas from an exhaust passage of an internal combustion engine back to an intake passage of the internal combustion engine. The EGR cooler system cools the exhaust gas to be sent back to the intake passage using a water-cooled EGR cooler.

2. Description of the Related Art

Usually, generation of NOx is suppressed as follows; part of the exhaust gas is extracted and cooled by a water-cooled EGR (Exhaust Gas Recirculation) cooler, and the cooled exhaust gas is sent back to an intake passage of the internal combustion engine to reduce the combustion temperature.

In such exhaust gas recirculation system, the EGR cooler is supplied with the coolant from the engine cooling system that cools a heated portion of the internal combustion engine. However, when a vehicle is stuck in heavy traffic, the coolant, which has been used to cool the heated portion of the internal combustion engine, is sometimes not sufficiently cooled and the temperature of the coolant remains high (for example, approximately 80° C.). If such high-temperature coolant is supplied to the EGR cooler, the exhaust gas cannot be sufficiently cooled.

According to Japanese Patent Application Publication No. JP-A-2004-204828, the coolant to be supplied to the EGR cooler is cooled by an EGR cooler system provided in a path that is separate from the path provided with the engine cooling system. The engine cooling system cools the coolant to be supplied to a heated portion of an internal combustion engine.

According to this technology, however, the coolant is sometimes excessively cooled by the EGR cooler system, for example, when the vehicle is running at a high peed or when the vehicle is in a cold environment. If such excessively cooled coolant is supplied to the EGR cooler, the exhaust gas is also excessively cooled, resulting in an excessive decrease in the temperature of an intake air in an intake passage. This may cause misfires in the internal combustion engine, adversely affecting the drivability.

SUMMARY OF THE INVENTION

An EGR cooler system according to an aspect of the invention includes a water-cooled EGR cooler that is included in an exhaust gas recirculation system which sends part of the exhaust gas from an exhaust passage of an internal combustion engine back to an intake passage of the internal combustion engine, and that cools the exhaust gas to be sent back to the intake passage. The EGR cooler system also includes an EGR cooler cooling device that is provided in a coolant path which is separate from the path provided with an engine cooling system. The engine cooling system cools coolant to be supplied to a heated portion of the internal combustion engine. The EGR cooler cooling device cools the coolant to be supplied to the water-cooled EGR cooler. The EGR cooler system further includes a water pump that circulates the coolant within the coolant path; a bypass passage through which the coolant may bypass the EGR cooler cooling device or the water-cooled EGR cooler; and a flow control valve that regulates the amount of coolant flowing into the bypass passage based on the temperature of the coolant flowing through the coolant path.

With the structure according to the aspect of the invention described above, the coolant to be supplied to the EGR cooler is cooled by the EGR cooler cooling device. The EGR cooler cooling device is provided in the coolant path that is separate from the path provided with the engine cooling system which cools the coolant to be supplied to the heated portion of the internal combustion engine. The flow control valve regulates the amount of coolant flowing into the bypass passage based on the temperature of the coolant flowing through the coolant path provided with the EGR cooler cooling device. The coolant may bypass the EGR cooler cooling device or the water-cooled EGR cooler through the bypass passage. As a result, the coolant flowing through the coolant path is efficiently cooled by the EGR cooler cooling device, for example, when the vehicle is stuck in heavy traffic. In addition, excessive cooling of the coolant flowing through the coolant path by the EGR cooler cooling device is prevented, even when the vehicle is running at a high speed or when the vehicle is in a cold environment. As a result, the temperature of the coolant to be supplied to the EGR cooler is stabilized. Thus, the excessively cooled coolant is prevented from being supplied to the EGR cooler. Therefore, misfires that may be caused by excessively cooled intake air due to excessive cooling of the exhaust gas are reliably prevented. In addition, the drivability is improved.

BRIEF DESCRIPTION OF THE DRAWINGS

The foregoing and/or further objects, features and advantages of the invention will become more apparent from the following description of example embodiment with reference to the accompanying drawings, wherein the same or corresponding portions will be denoted by the same reference numerals and wherein.

DETAILED DESCRIPTION OF THE EXAMPLE EMBODIMENT

In the following description, the invention will be described in more detail in terms of an example embodiment.

Figure 1:
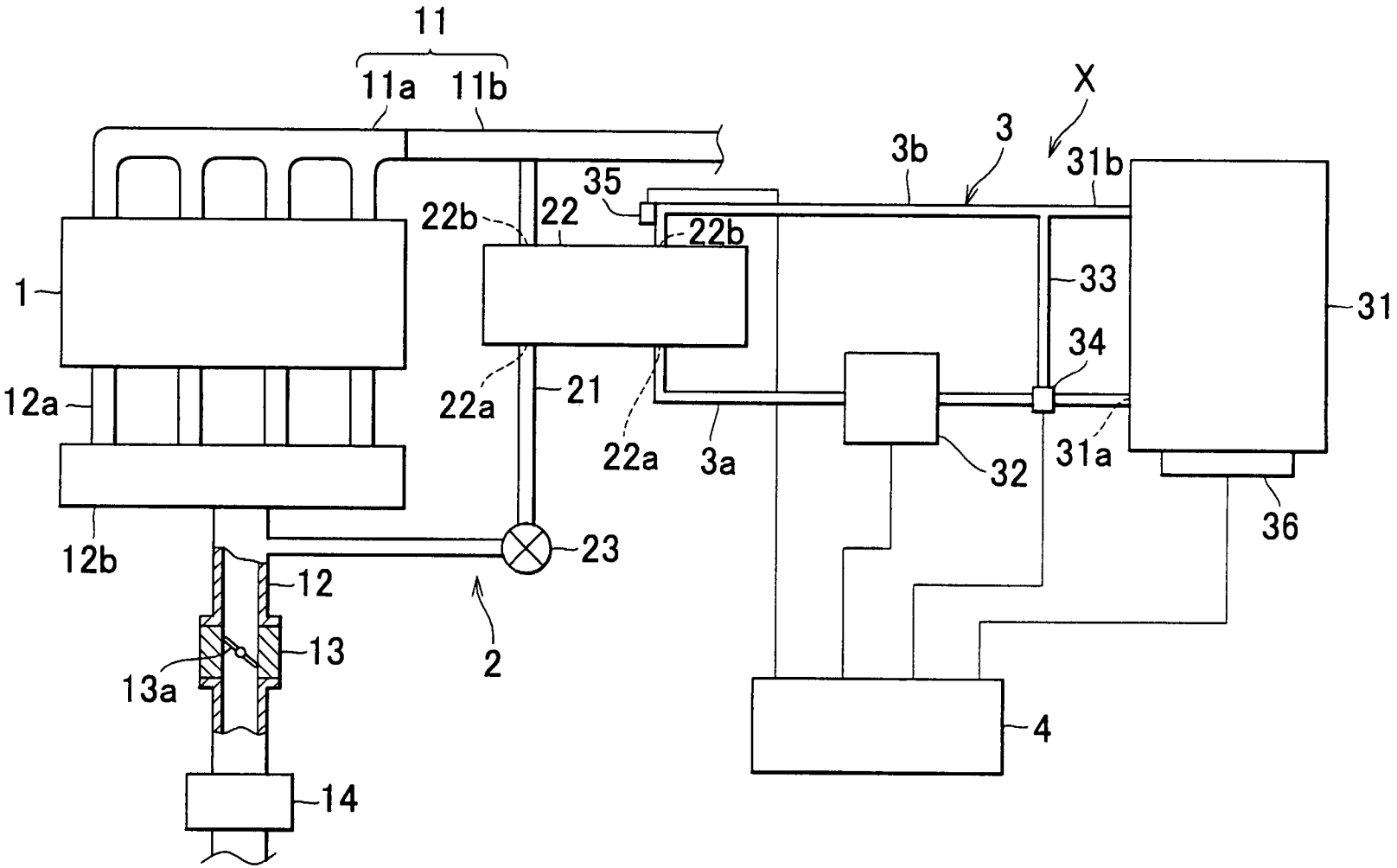
FIG. 1 illustrates the view schematically showing the structure of an EGR cooler system according to an embodiment of the invention.
Figure 2:
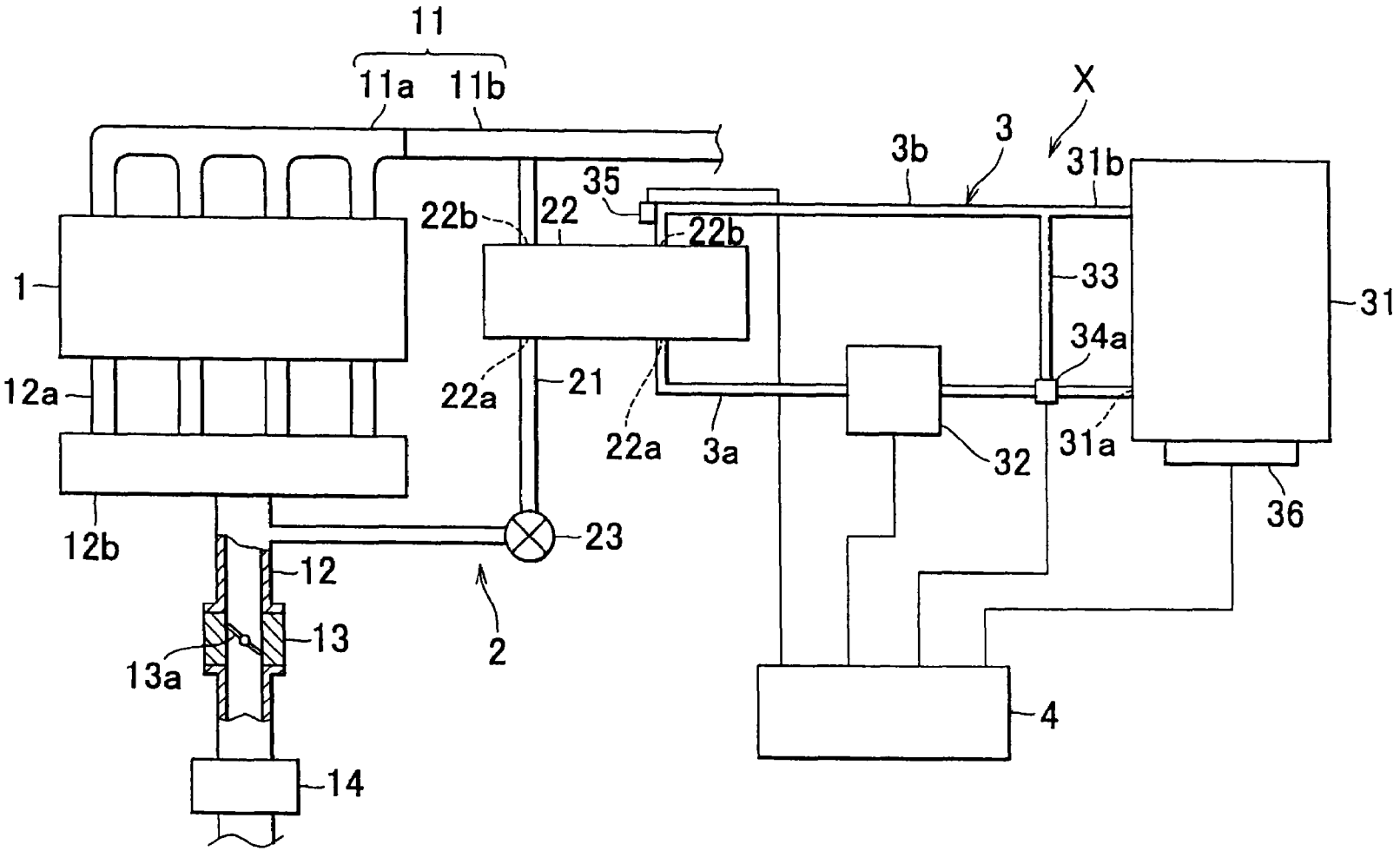
FIG. 2 illustrates another embodiment in which the flow control valve is replaced by a thermostat.

FIG. 1 shows the schematic view of the structure of an EGR cooler system according to an embodiment of the invention, which is provided for an exhaust gas recirculation system. As shown in FIG. 1, an exhaust manifold 11*a* is connected to the exhaust ports of an in-line four-cylinder internal combustion engine 1. An exhaust pipe 11*b* is connected to the exhaust manifold 11*a*. The exhaust manifold 11*a* and the exhaust pipe 11*b* form an exhaust passage 11. An intake pipe 12*a* is connected to the internal combustion engine 1. A surge tank 12*b* is formed integrally with an intake passage 12. A throttle body 13 housing a throttle valve 13*a*, and an air-cleaner 14, which is provided upstream of the throttle body 13, are provided in the intake passage 12. An exhaust gas recirculation system 2 is provided between the exhaust passage 11 and the intake passage 12. The exhaust gas recirculation system 2 sends part of the exhaust gas from the exhaust passage 11 of an internal combustion engine 1 back to the intake passage 12 of the internal combustion engine 1. The exhaust gas recirculation system 2 includes an EGR passage 21 that connects the exhaust passage 11 to the intake passage 12; an EGR cooler 22 that cools the exhaust gas recirculated through the EGR passage 21 using coolant; and an EGR valve 23 that controls the amount of exhaust gas recirculated through the EGR passage 21.

The coolant to be supplied to the EGR cooler 22 is cooled by a sub-radiator 31 that serves as an EGR cooler cooling device. The sub-radiator 31 is provided in a coolant path 3 that is separate from the path provided with a main-radiator. The main-radiator serves as an engine cooling system that cools the coolant to be supplied to a heated portion of the internal combustion engine 1. The coolant path 3, an electric water pump 32, a bypass passage 33, and an electric flow control valve 34 (flow control valve) form an EGR cooler system X. The electric water pump 32 circulates the coolant within the coolant path 3. The coolant may bypass the sub-radiator 31 through the bypass passage 33. The electric flow control valve 34 regulates the opening amount of a valve element to control the amount of coolant flowing into the bypass passage 33. The electric water pump 32 is provided in a first duct 3*a* of the coolant path 3, which connects a coolant outlet 31*a* of the sub-radiator 31 to a coolant inlet 22*a* of the EGR cooler 22. The bypass passage 33 serves as a shortcut between the first duct 3*a* and a second duct 3*b*. The second duct 3*b* connects a coolant outlet 22*b* of the EGR cooler 22 to a coolant inlet 31*b* of the sub-radiator 31. The bypass passage 33 branches off from the first duct 3*a* at a position upstream of the electric water pump 32. The electric flow control valve 34 is provided in the first duct 3*a* at a position upstream of the electric water pump 32. The electric flow control valve 34 is provided at the branching point. The electric flow control valve 34 regulates the opening amount of valve element to control the amount of coolant flowing into the bypass passage 33. Thus, the electric flow control valve 34 controls the amount of coolant cooled by the sub-radiator 31.

The EGR cooler system X also includes a coolant temperature sensor 35 that detects the temperature of the coolant, and a cooling fan 36 that forcibly supplies airflow to the sub-radiator 31. The coolant temperature sensor 35 is provided at the upstream end of the second duct 3*b* of the coolant path 3, that is, immediately downstream of the coolant outlet 22*b* of the EGR cooler 22. The coolant temperature sensor 35 detects the temperature of the coolant flowing out of the coolant outlet 22*b* of the EGR cooler 22. The cooling fan 36 controls the amount of airflow supplied to the sub-radiator 31. The EGR cooler system X also includes an ECU (electronic control unit) 4 that controls the operations of the electric water pump 32, the electric flow control valve 34, and the cooling fan 36.

The ECU 4 transmits a command signal to the electric water pump 32 based on the signal from the coolant temperature sensor 35 in order to control the amount of coolant circulating within the coolant path 3. The ECU 4 also transmits a command signal to the electric flow control valve 34 based on the signal from the coolant temperature sensor 35 in order to control the amount of coolant flowing into the bypass passage 33. In addition, the ECU 4 transmits a command signal to the cooling fan 36 based on the signal from the coolant temperature sensor 35 in order to control the amount of airflow supplied to the sub-radiator 31.

In the embodiment described above, the coolant to be supplied to the EGR cooler 22 is cooled by the sub-radiator 31. The sub-radiator 31 is provided in the coolant path 3 that is separate from the path provided with the main-radiator which cools the coolant to be supplied to the heated portion of the internal combustion engine 1. The electric flow control valve 34 controls the amount of coolant flowing into the bypass passage 33 based on the coolant temperature detected by the coolant temperature sensor 35 provided immediately downstream of the coolant outlet 22*b* of the EGR cooler 22. With this structure, the sub-radiator 31 efficiently cools the coolant flowing through the coolant path 3, for example, when the vehicle is stuck in heavy traffic. In addition, excessive cooling of the coolant flowing through the coolant path 3 by the sub-radiator 31 is prevented, even when the vehicle is running at a high speed or when the vehicle is in a cold environment. As a result, the temperature of the coolant to be supplied to the EGR cooler 22 is stabilized. Thus, the excessively cooled coolant is prevented from being supplied to the EGR cooler 22. Therefore, misfires that may be caused by excessively cooled intake air are reliably prevented. In addition, the drivability is improved.

In the structure described above, the sub-radiator 31 is provided with the cooling fan 36. The amount of airflow supplied from the cooling fan 36 to the sub-radiator 31 is controlled based on the signal from the coolant temperature sensor 35. Therefore, the amount of airflow supplied from the cooling fan 36 to the sub-radiator 31 is controlled based on the signal from the coolant temperature sensor 35, that is, the temperature of the coolant detected immediately downstream of the coolant outlet 22*b* of the EGR cooler 22. As a result, the radiation efficiency of the sub-radiator 31, which is likely to be reduced, for example, when the vehicle is stuck in heavy traffic, is sufficiently maintained, thus enhancing the radiation efficiency of the sub-radiator with compact hardware configuration.

With the structure described above, the amount of coolant circulating within the coolant path 3 is controlled by the electric water pump 32 based on the signal from the coolant temperature sensor 35. Accordingly, for example, when the coolant does not need to be circulated within the coolant path 3, the electric water pump 32 is stopped. As a result, reduction in the fuel efficiency is prevented.

The invention is not limited to the embodiment described above. To the contrary, the invention is intended to cover various modifications and equivalent arrangements. For example, in the embodiment described above, the amount of coolant flowing into the bypass passage 33 is controlled by the electric flow control valve 34 that is controlled by the ECU 4 based on the signal from the coolant temperature sensor 35. Alternatively, a thermostat 34A may be used as the flow control valve. The thermostat 34A controls the amount of coolant flowing into the bypass passage 33 based on the temperature of the coolant flowing through the coolant path 3. In this case, the amount of coolant flowing into the bypass passage 33 is controlled with simple structure. In the embodiment described above, the electric flow control valve 34 is provided in the first duct 3*a* at the position upstream of the electric water pump 32. The bypass passage 33 branches off from the first duct 3*a*, and there is the electric flow control valve 34 at the branching point. Alternatively, the electric flow control valve may be provided in the second duct 3*b* at the position downstream of the coolant temperature sensor 35. In this case, the bypass passage 33 branches off from the second duct 3*b*, and the electric flow control valve 34 may be provided at the branching point.

In the embodiment described above, the bypass passage 33 is connected to the first duct 3*a* at the position upstream of the electric water pump 32. The bypass passage 33 is also connected to the second duct 3*b* at the position between the coolant inlet 22*b* of the EGR cooler 22 and the coolant inlet 31*b* of the sub-radiator 31. Alternatively, the bypass passage 33 may be connected to the first duct 3*a* at the position downstream of the electric water pump 32, and also connected to the second duct 3*b* at the position upstream of the coolant temperature sensor 35.

In the embodiment described above, the temperature of the coolant flowing out of the coolant outlet 22*b* of the EGR cooler 22 is detected by the coolant temperature sensor 35. Alternatively, a coolant temperature switch may be provided at the upstream end of the second duct 3*b* of the coolant path 3, that is, immediately downstream of the coolant outlet 3*b* of the EGR cooler 22. The coolant temperature switch is turned ON/OFF based on the temperature of the coolant flowing out of the coolant outlet 22*b* of the EGR cooler 22. In this case, the electric water pump 32, the electric flow control valve 34, and the cooling fan 36 are controlled based only on a signal indicating whether the coolant temperature switch is ON or OFF. As a result, the control system of the ECU is simplified.

While the invention has been described with reference to the example embodiment thereof, it should be understood that the invention is not limited to the example embodiment or construction. To the contrary, the invention is intended to cover various modifications and equivalent arrangements. In addition, while the various elements of the example embodiment are shown in various combinations and configurations, which are exemplary, other combinations and configurations, including more, less or only a single element, are also within the spirit and scope of the invention.

What is claimed is:

1. An EGR cooler system, comprising:

a water-cooled EGR cooler that is included in an exhaust gas recirculation system which sends part of exhaust gas from an exhaust passage of an internal combustion engine back to an intake passage of the internal combustion engine, and that cools the exhaust gas to be sent back to the intake passage;

an EGR cooler cooling device capable of cooling coolant to be supplied to a heated portion of the internal combustion engine and coolant to be supplied to the water-cooled EGR cooler;

a coolant path which is separate from a path provided with an engine cooling system, wherein the coolant path connects the EGR cooler and the EGR cooler cooling device;

a water pump that circulates the coolant within the coolant path such that coolant cooled by the EGR cooler cooling device reaches the EGR cooler without cooling the internal combustion engine;

a bypass passage through which the coolant in the coolant path may bypass the EGR cooler cooling device or the water-cooled EGR cooler; and a flow control valve that regulates an amount of coolant flowing into the bypass passage based on a temperature of the coolant flowing through the coolant path.

2. The EGR cooler system according to claim 1, further comprising:

a coolant temperature sensor that detects the temperature of the coolant flowing out of a coolant outlet of the water-cooled EGR cooler, and that is provided in the coolant path at a position immediately downstream of the water-cooled EGR cooler; or a coolant temperature switch that is turned ON or OFF based on the temperature of the coolant flowing out of the coolant outlet of the water-cooled EGR cooler, and that is provided in the coolant path at the position immediately downstream of the water-cooled EGR cooler.

3. The EGR cooler system according to claim 2, wherein the EGR cooler cooling device is provided with a cooling fan that is controlled based on an output from the coolant temperature sensor or the coolant temperature switch.

4. The EGR cooler system according to claim 2, wherein the water pump is an electric water pump that controls an amount of coolant circulating within the coolant path based on an output from the coolant temperature sensor or the coolant temperature switch.

5. The EGR cooler system according to claim 3, wherein the water pump is an electric water pump that controls an amount of coolant circulating within the coolant path based on an output from the coolant temperature sensor or the coolant temperature switch.

6. The EGR cooler system according to claim 2, wherein the flow control valve is an electric flow control valve that regulates an opening amount of a valve element to control the amount of coolant flowing into the bypass passage based on an output from the coolant temperature sensor or the coolant temperature switch.

7. The EGR cooler system according to claim 3, wherein the flow control valve is an electric flow control valve that regulates an opening amount of a valve element to control the amount of coolant flowing into the bypass passage based on an output from the coolant temperature sensor or the coolant temperature switch.

8. The EGR cooler system according to claim 4, wherein the flow control valve is an electric flow control valve that regulates an opening amount of a valve element to control the amount of coolant flowing into the bypass passage based on an output from the coolant temperature sensor or the coolant temperature switch.

9. The EGR cooler system according to claim 5, wherein the flow control valve is an electric flow control valve that regulates an opening amount of a valve element to control the amount of coolant flowing into the bypass passage based on an output from the coolant temperature sensor or the coolant temperature switch.

10. The EGR cooler system according to claim 1, wherein the flow control valve is a thermostat that regulates the amount coolant flowing into the bypass passage based on the temperature of the coolant flowing through the coolant path.

11. The EGR cooler system according to claim 3, wherein the flow control valve is a thermostat that regulates the amount coolant flowing into the bypass passage based on the temperature of the coolant flowing through the coolant path.

12. The EGR cooler system according to claim 4, wherein the flow control valve is a thermostat that regulates the amount coolant flowing into the bypass passage based on the temperature of the coolant flowing through the coolant path.

13. The EGR cooler system according to claim 5, wherein the flow control valve is a thermostat that regulates the amount coolant flowing into the bypass passage based on the temperature of the coolant flowing through the coolant path.

14. The EGR cooler system according to claim 6, wherein the flow control valve is a thermostat that regulates the amount coolant flowing into the bypass passage based on the temperature of the coolant flowing through the coolant path.

15. The EGR cooler system according to claim 7, wherein the flow control valve is a thermostat that regulates the amount coolant flowing into the bypass passage based on the temperature of the coolant flowing through the coolant path.

16. The EGR cooler system according to claim 8, wherein the flow control valve is a thermostat that regulates the amount coolant flowing into the bypass passage based on the temperature of the coolant flowing through the coolant path.

17. The EGR cooler system according to claim 9, wherein the flow control valve is a thermostat that regulates the amount coolant flowing into the bypass passage based on the temperature of the coolant flowing through the coolant path.

* * * * *